US007930784B2

(12) United States Patent
Jew et al.

(10) Patent No.: US 7,930,784 B2
(45) Date of Patent: Apr. 26, 2011

(54) INFANT MATTRESS WITH CURVED TOP SURFACE

(76) Inventors: Leon Emmanuel Jew, Pleasanton, CA (US); Sydney Furan Jew, Pleasanton, CA (US); Leona Bonanza Jew, Pleasanton, CA (US)

( * ) Notice: Subject to any disclaimer, the term of this patent is extended or adjusted under 35 U.S.C. 154(b) by 114 days.

(21) Appl. No.: 12/584,602

(22) Filed: Sep. 9, 2009

(65) Prior Publication Data

US 2011/0056025 A1 Mar. 10, 2011

(51) Int. Cl.
*A47C 27/00* (2006.01)

(52) U.S. Cl. ..... 5/731; 5/655

(58) Field of Classification Search ..... 5/633, 655, 5/660, 731–735, 738
See application file for complete search history.

*Primary Examiner* — Michael Trettel
(74) *Attorney, Agent, or Firm* — Dahyee Law Group

(57) ABSTRACT

Embodiments of the present invention provide an apparatus to be used as an alternative infant mattress having a curved top surface which is formed based on a curve comprising a segment of sine wave and a segment of tail line. The segment of sine wave preferably consists of a partial wave crest and a full wave trough. The length of the apparatus is preferably identical to the wave length of the sine wave.

20 Claims, 8 Drawing Sheets

INFANT MATTRESS WITH CURVED TOP SURFACE

FIELD OF THE INVENTION

The present invention relates generally to bed and mattress. More particularly, it relates to an alternative infant mattress with a curved top surface.

BACKGROUND OF THE INVENTION

The flat mattress with planar top surface has been used for at least two thousand years. It has been taken granted that a mattress has a planar flat top surface. But this is not unchallengeable.

It is noted that many infants younger than three months are very sensitive to the outside worlds. Their hands are moving and grasping in the air. They can be easily startled even by a mini-tiny sound or air movement. When they are placed in a belly-sleeping position, however, their palms and fingers touch the mattress and they fell asleep quickly.

Belly-sleeping must be under close supervision because sudden infant death syndrome (herein after as SIDS) occurs in belly-sleeping position is more often than that in sleeping-on-the back position. Infants are more likely to have apnea (pauses in breathing) when they sleep on their stomachs on flat beds. They are also more likely to re-breathe the air they have just exhaled, which can raise their levels of carbon dioxide. The increased retention of body heat can also be dangerous for some infants. It is estimated that belly-sleep in conventional flat bed has up to many times the risk of death as back-sleep. In response to the statistics, the medical professionals simply advocate against belly-sleep and promote back-sleep.

What is desired is an apparatus which enables belly-sleeping and decreases the possibility of SIDS by reducing the weight of the baby's head applied on her face and nasal area and increasing the baby's ability to turn her head.

SUMMARY OF INVENTION

The primary objective of the present invention is to provide an infant mattress which enables a baby to sleep on her belly on a sine wave based slope. The second objective is to provide a ventilation means on the slope to void retention of too much body heat while the baby sleeps on her belly.

The infant mattress according to the invention includes a single piece three-dimensional body with elastic properties and a textile case encasing the mattress body. The mattress body has a top view of a rectangle, a curved top surface, a planar bottom surface located opposite of the curved top surface, a pair of identical longitudinal side surfaces paralleling to each other, and two latitudinal side surfaces paralleling to each other. Each of the longitudinal side surfaces includes a curved top line, a first vertical line, a horizontal bottom line and a second vertical line paralleling to the first vertical line. The bottom line is connected to the first and the second vertical lines' lower ends respectively, and the curved top line is connected to the first and the second vertical lines' upper ends respectively. The curved top line includes a sine wave and a segment of tail line. The sine wave includes only one crest segment and one trough segment. The tail line segment is connected to an end of the trough segment. The curved top surface is formed by a translational motion of the curved top line along the rectangle's latitudinal direction for a distance of the rectangle's width.

The sine wave constituting the top curved line can be any of: (1) a curve consisting of a full crest and a full trough; (2) a curve consisting of a full crest and a partial trough; (3) a curve consisting of a partial crest and a full trough; and (4) a curve consisting of a partial crest and a partial trough.

The tail line segment can be a straight line or a curve such as a circular arc, a segment of an ellipse, a segment of a hyperbola, a segment of a parabola, a segment of the sine wave with a horizontal length shorter than one fourth of the sine wave's wavelength; and a combination of two or more of these.

In the most preferable configuration, the mattress body's longitudinal length is substantially equal to the sine wave's wavelength, and the horizontal length of the tail line segment is substantially equal to a horizontal length corresponding to a segment of crest which would make the partial crest a full crest.

The mattress body according the invention may include an array of three dimensional ventilation pits carved on the curved surface's main slope. The ventilation pits can be in any shape. It can be customized according to the end user's selection from a variety of designs.

In another embodiment, the mattress body includes a single piece three-dimensional shape carved on the main slope of the curved top surface. The single piece shape is proportionally customized by imitating an object, such as a baby's ear, a baby's foot print, a baby's hand print, or any other three-dimensional art work.

The mattress body is made of elastic materials. In a configuration where the mattress body has two or more layers coupled together, each two neighboring layers are made of different materials, but the top layer must be made of elastic materials. In another configuration, a bottom layer includes a plastic case and a container, such as a drawer, which is detachably coupled to the case.

The advantages of the present invention are numerous. First, the baby's weight is decentralized by the sine wave based slope, the weight of the baby's head applied on her face is reduced, the baby's ability to turn her head is increased and thus the possibility of SIDS is minimized. Second, it gives the baby a bigger space and re-breathing is minimized. Third, sleeping on the slope, the baby has less chance to choke on fluids she brings up. Fourth, sleeping on the slope, the baby's chance to get positional facial and head deformities is lower.

The various features of novelty which characterize the invention are pointed out with particularly in the claims annexed to and forming a part of this disclosure. For a better understanding of the invention, its operating advantages and specific objects attained for its use, reference should be made to the drawings and descriptive matters in which there are illustrated and described preferred embodiments of the invention.

DESCRIPTION OF INVENTION

The following detailed description of the invention references the accompanying drawings which illustrate specific embodiments in which the invention can be practiced. The embodiments are intended to describe aspects of the invention in sufficient detail to enable those skilled in the art to practice the invention. Other embodiments can be utilized and changes in size, angle, materials, etc. can be made without departing from the spirit and scope of the present invention. The following detailed description is, therefore, not to be taken in a limiting sense. The scope of the present invention is defined only by the appended claims, along with the full scope of equivalents to which such claims are entitled.

The essence of the present invention is to provide a sine-wave-based curved top surface to decentralize a baby's weight and to increase the baby's ability to turn her head while the baby is in a sleep-on-belly position. When the baby is on her belly on a sine-wave based slope, she is less likely to re-breathe the air she has just exhaled.

Figure 1:
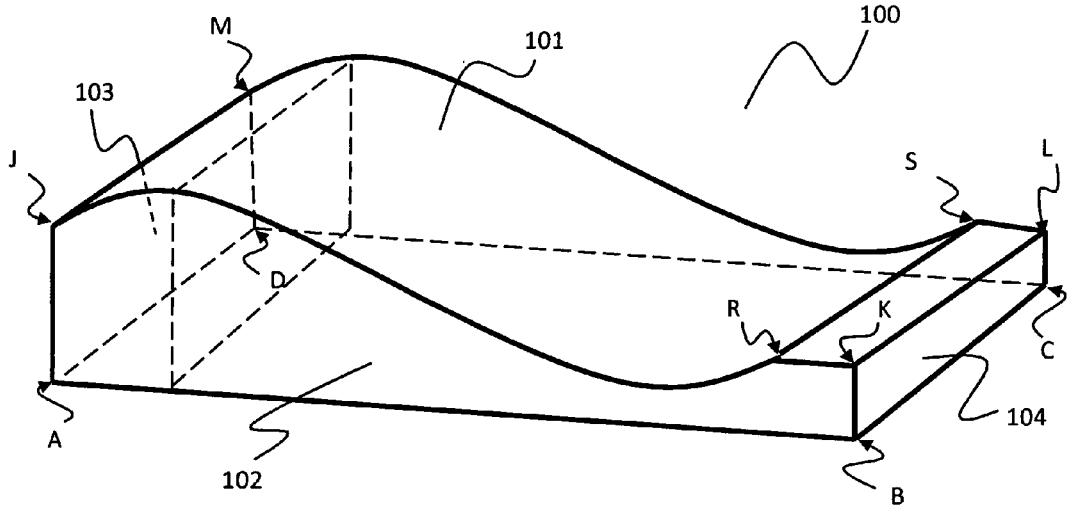
FIG. 1 is a perspective view illustrating an exemplary embodiment of a mattress body according to the invention.

In one preferred embodiment according to the invention, the infant mattress includes a single piece mattress body and a mattress cover encasing the mattress body. Referring to FIG. 1, which is a perspective view illustrating an exemplary embodiment of a mattress body according to the invention, the mattress body 100 is a three-dimensional figure having a top view of a rectangle A-B-C-D and six surfaces: a curved top surface 101 (J-K-L-M), a planar bottom surface identified by A-B-C-D which is located opposite of the curved top surface 101, a pair of identical longitudinal side surfaces 102 (A-B-K-R-J, D-C-L-S-M) paralleling to each other, and two latitudinal rectangular side surfaces 103 (A-D-M-J) and 104 (B-C-L-K) paralleling to each other. Each of the longitudinal side surfaces is a two-dimensional four-side closed curve including a curved top line J~R-K, a first vertical line A-J, a horizontal bottom line A-B and a second vertical line B-K paralleling to the first vertical line A-J. The bottom line A-B is connected to the first vertical line's lower end A and to the second vertical line's lower end B respectively. The curved top line J~R-K is connected to the first vertical line's upper end J and the second vertical line's upper end K respectively.

Figure 2:
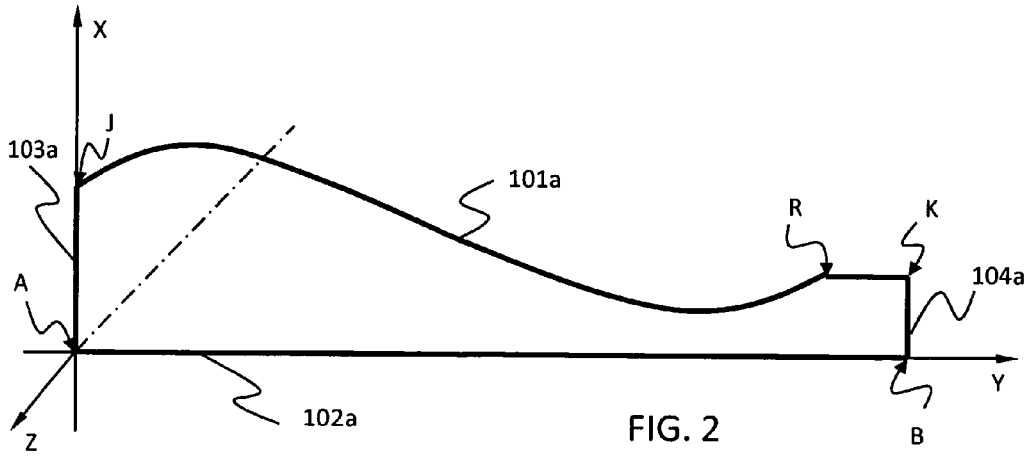
FIG. 2 is a geometrical diagram illustrating a side view of the mattress body of FIG. 1.

Now referring to FIG. 2, which is a side view of the mattress body of FIG. 1, the longitudinal side surface 102 includes four sides, i.e., the curved top line 101*a*, the first vertical line 103*a*, the second vertical line 104*a*, and the bottom line 102*a*. The curved top line 101*a* (J-R-K) consists two parts: a segment of a sine wave (J~R) and a segment of a tail line (R-K). The mattress body's curved top surface 101 in FIG. 1 is geometrically formed by a translational motion of the curved top line 101*a* along the rectangle's latitudinal direction (A→D, B→C) for a distance of the rectangle's width (AD, BC).

Figure 3:
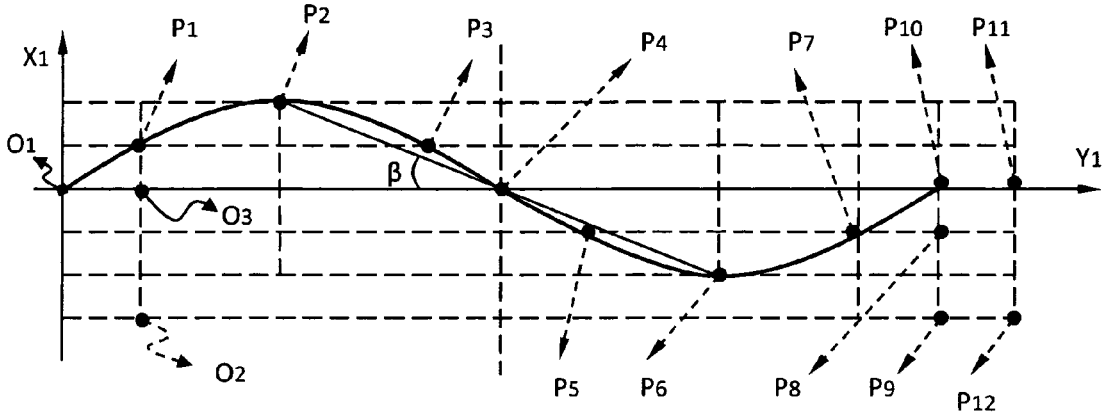
FIG. 3 is a geometrical diagram illustrating a sine wave which is used for forming a curved top line of FIG. 2.

FIG. 3 is a geometrical diagram illustrating the sine wave used to form the curved top surface of the mattress body according to FIG. 1. The sine wave J~R in FIG. 1 and FIG. 2 includes only one crest segment and one trough segment. In this specification, the segment from point $O_1$ to point $P_4$ is defined as a full crest segment, and the segment from point $P_4$ to point $P_{10}$ is defined as a full trough. Accordingly, any segment between $O_1$ and point $P_4$ is referred as crest segment, and any segment between $P_4$ and point $P_{10}$ is referred as crest segment. The segment from $P_2$ to $P_6$ is defined as the main slope of the sine wave. In application, the angle β between the slope line $P_2$-$P_6$ and the horizontal axis $Y_1$ is less than 45 degree, and preferably between 30 degree and 36 degree.

Referring back to FIG. 2, the segment of tail line (R-K) is connected to the end of the trough segment of the sine wave. The sine wave (J~R) in FIG. 1 and FIG. 2 can be configured in four different formats: (1) a full crest and a full trough; (2) a full crest and a partial trough; (3) a partial crest and a full trough; and (4) a partial crest and a partial trough.

Figure 4:
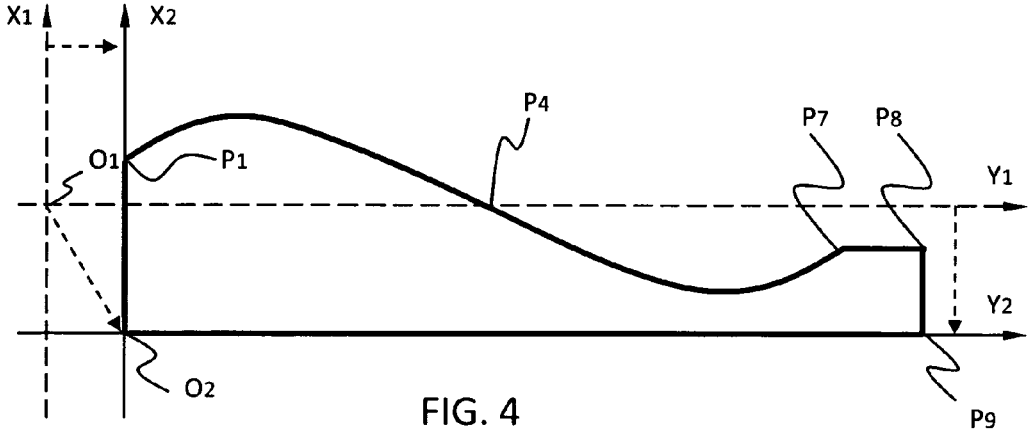
FIG. 4 is a geometrical diagram illustrating a side view with a curved top line in which the sine wave includes a partial crest and a partial trough.

FIG. 4 illustrates a format of a partial crest and a partial trough. This configuration is especially beneficial to the infants younger than 45 days.

Figure 5:
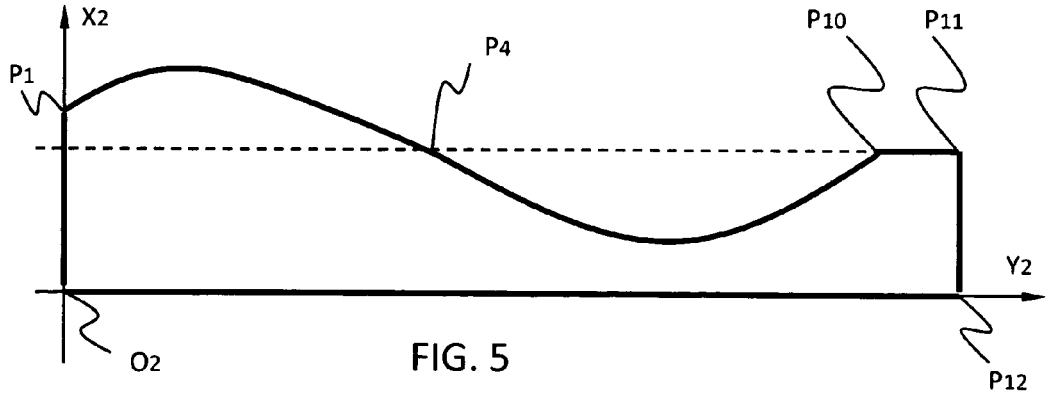
FIG. 5 is a geometrical diagram illustrating a side view with a curved top line in which the sine wave includes a partial crest and a full trough.

FIG. 5 illustrates a format of a partial crest ($P_1$-$P_4$) and a full trough ($P_4$-$P_{10}$). According to our tests, the configuration illustrated in FIG. 5 is the best mode. Referring back to FIG. 3 and FIG. 4, the length of the segment of tail line $P_{10}$-$P_{11}$ (R-K, in FIG. 1 and FIG. 2) is preferably configured as the distance from $X_1$ to $X_2$, i.e., $O_1$ to $O_3$, such that the longitudinal length of the infant mattress $O_2$ to $P_{12}$ is identical to or substantially equal to the wavelength of the sine wave in FIG. 3. In other words, the wave length $O_1$ to $P_{10}$ in FIG. 3 is identical to or substantially equal to the length $O_2$ to $P_{12}$. The tail line's length ($P_{10}$-$P_{11}$) is thus identical to or substantially equal to the longitudinal length $O_1$ to $O_3$ corresponding to the crest segment $O_1$ to $P_1$ which would make the partial crest $P_1$ to $P_4$ a full crest $O_1$ to $P_4$. With the special feature, the product is also called wavelength mattress.

The tail line $P_{10}$-$P_{11}$ can be any differentiable or non-differentiable line. For example, it can be any of: a segment of a straight line as illustrated in FIG. 1, FIG. 2, FIG. 4 and FIG. 5; a circular arc; a segment of an ellipse; a segment of a hyperbola; a segment of a parabola; a segment of the sine wave with a length shorter than one fourth of the sine wave's wavelength; and a combination of two or more of these lines.

Figure 6:
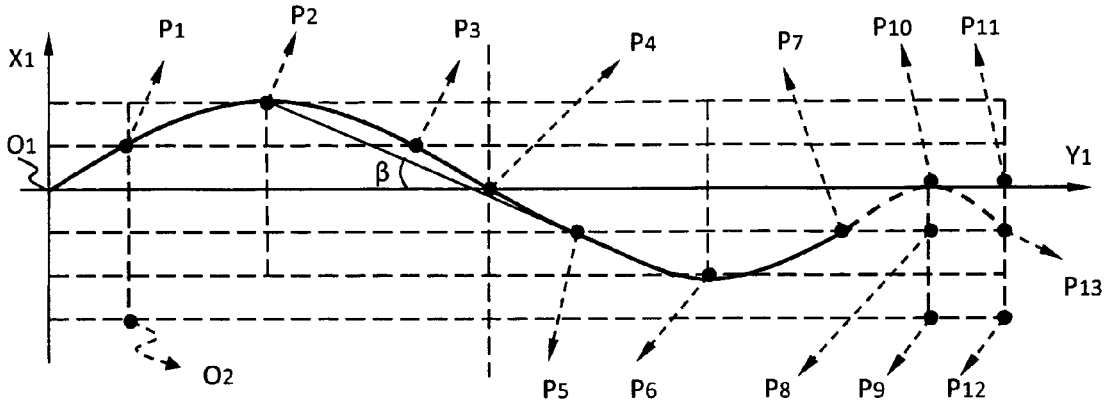
FIG. 6 is a geometrical diagram illustrating a sine wave and a curved tail line used for forming a curved top surface of the mattress body according to the invention.

FIG. 6 illustrates a configuration with a partial crest and a partial trough with a curved tail line $P_7$-$P_{10}$-$P_{13}$.

Figure 7:
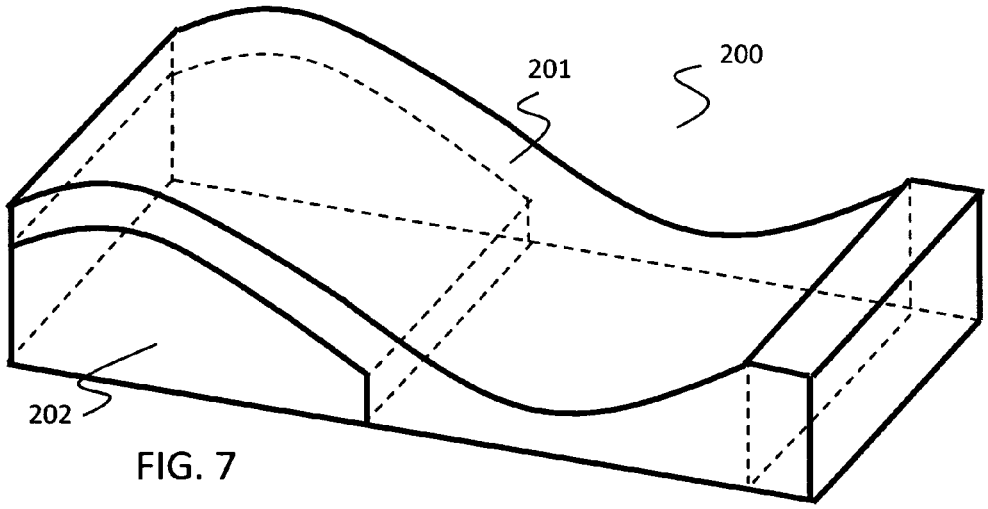
FIG. 7 is a perspective view of a mattress body which has a top layer and bottom layer.
Figure 8:
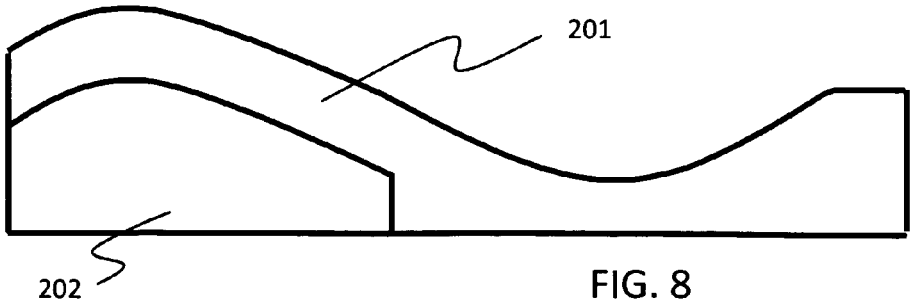
FIG. 8 is a side view of the mattress body of FIG. 7.

The single piece body of the infant mattress according to the invention may include two or more layers coupled together, each two neighboring layers being made of different materials. FIG. 7 and FIG. 8 illustrate a perspective view and a side view of two layer configuration 200 of the mattress body according to the invention which includes the top layer 201 made of elastic materials and the bottom layer 202 made of lightweight non-elastic materials.

Figure 9:
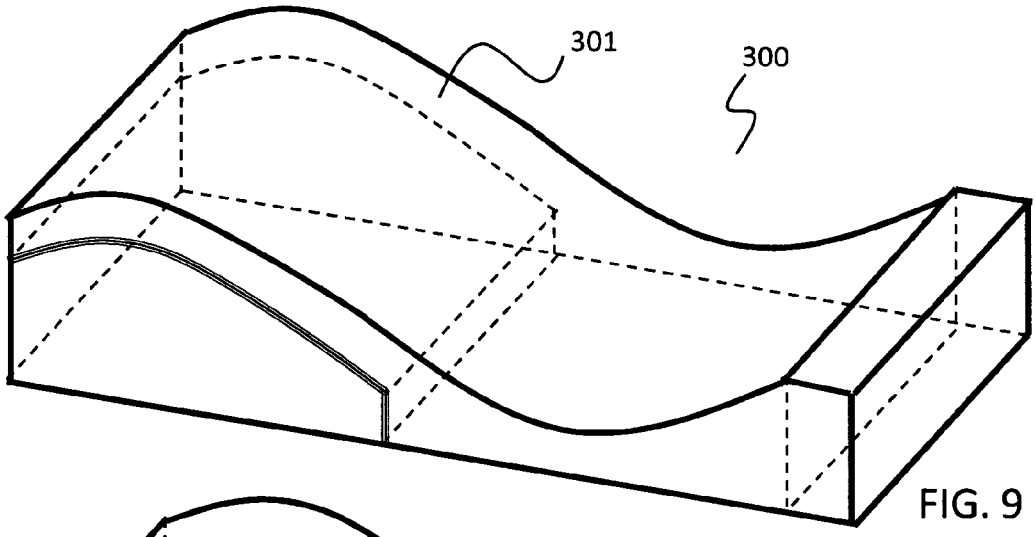
FIG. 9 is a perspective view of a mattress body which has a bottom frame to which the top layer is coupled.
Figure 10:
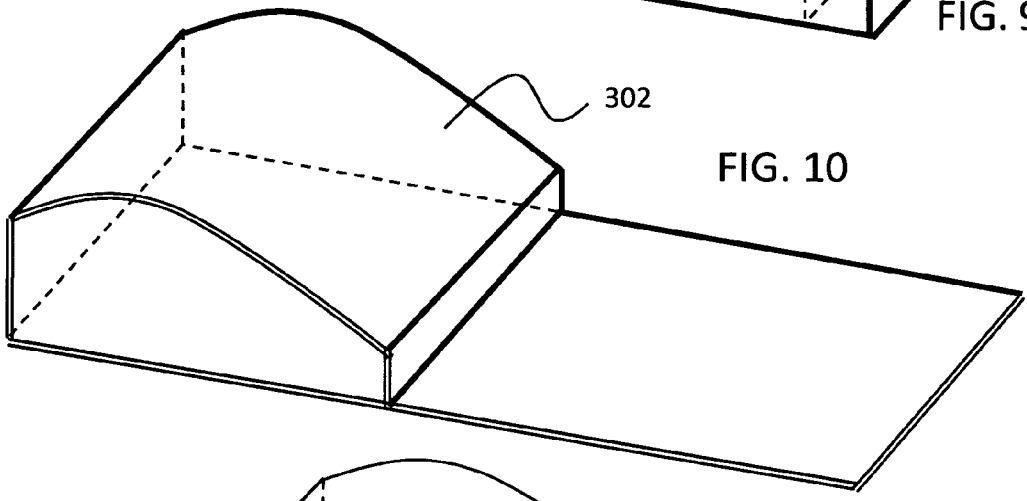
FIG. 10 is a perspective view of the bottom frame in the mattress body of FIG. 9.
Figure 11:
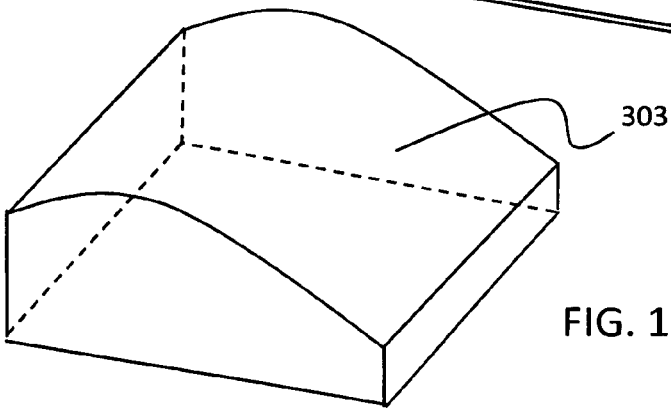
FIG. 11 is a perspective view of an exemplary container which can be inserted in or removed from the bottom frame of FIG. 10.

FIG. 9, FIG. 10 and FIG. 11 illustrate a three layer configuration 300 of the mattress body according to the invention, which includes a top layer 301 made of elastic materials, a second layer 302 which provides a non-elastic frame such as a plastic case, and a third layer 303 which can be a container or a drawer. The first layer 301 and the second layer 302 are coupled together. The third layer 303 is removable.

Figure 12:
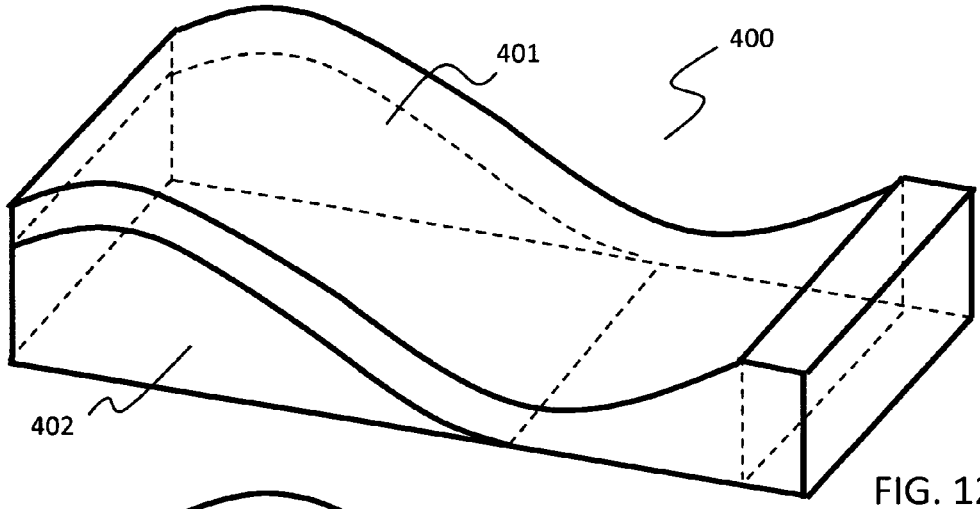
FIG. 12 is a perspective view of a two-layer mattress body according to another embodiment of the invention.
Figure 13:
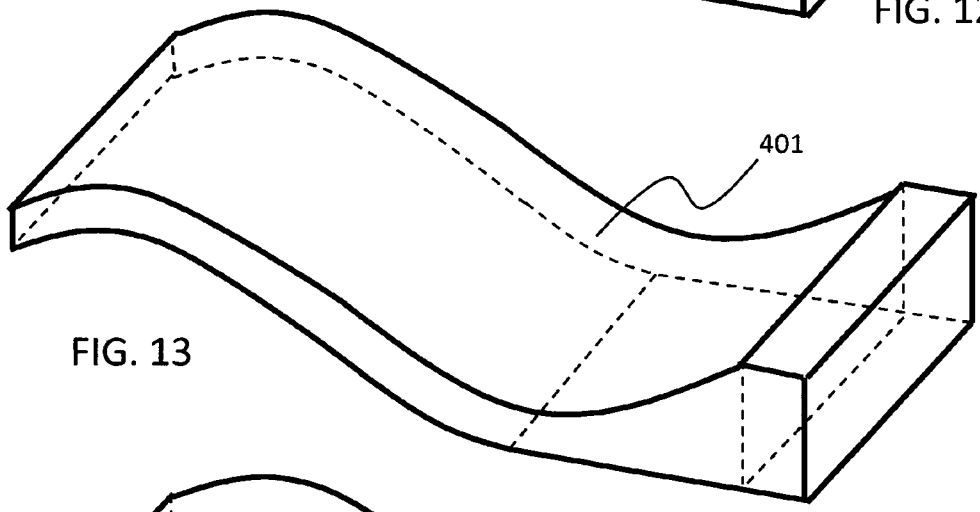
FIG. 13 is a perspective view of the curved top layer in the mattress body of FIG. 12.
Figure 14:
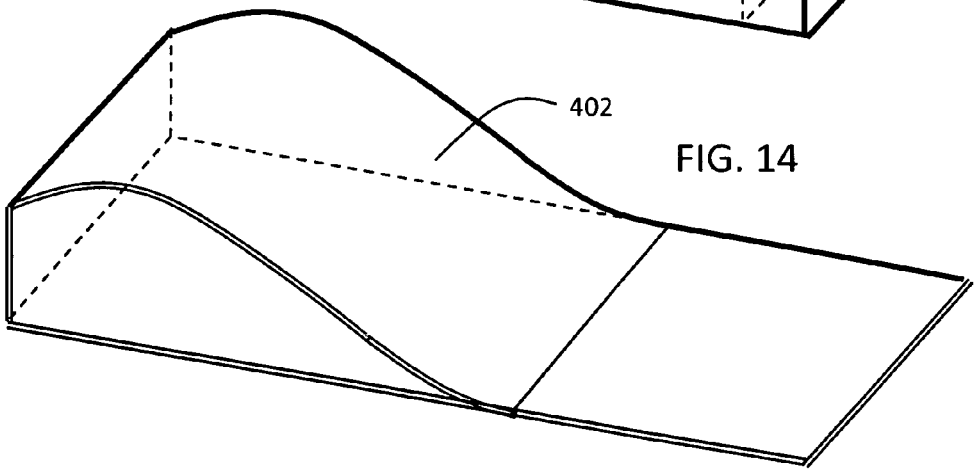
FIG. 14 is a perspective view of the bottom layer in the mattress body of FIG. 12.

FIG. 12, FIG. 13 and FIG. 14 illustrate another two layer configuration 400 of the mattress body according to the invention which includes the top layer 401 made of elastic materials and the bottom layer 402 which are coupled together. The bottom layer 402 is made of lightweight non-elastic materials. Alternatively, the bottom layer 402 can be a plastic frame or case.

Figure 15:
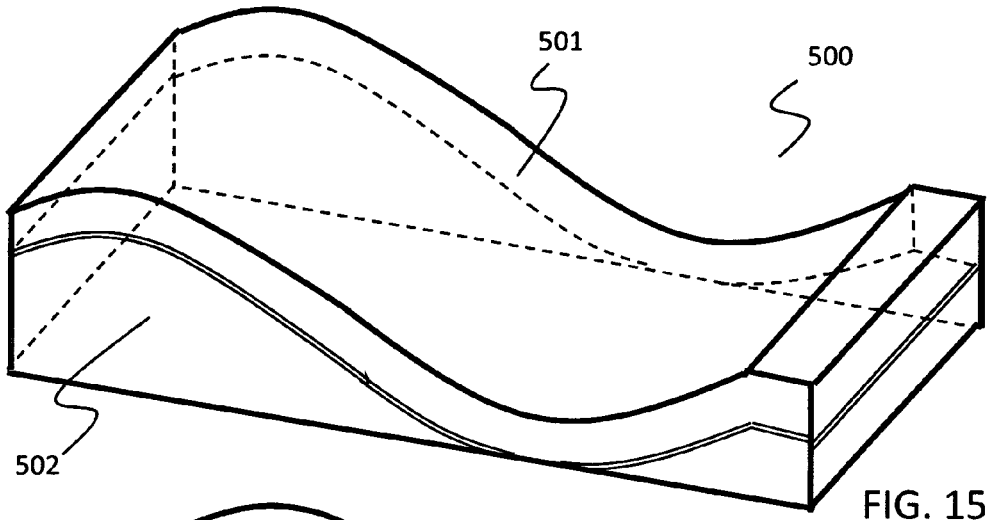
FIG. 15 is a perspective view of a two-layer mattress body according to another embodiment of the invention.
Figure 16:
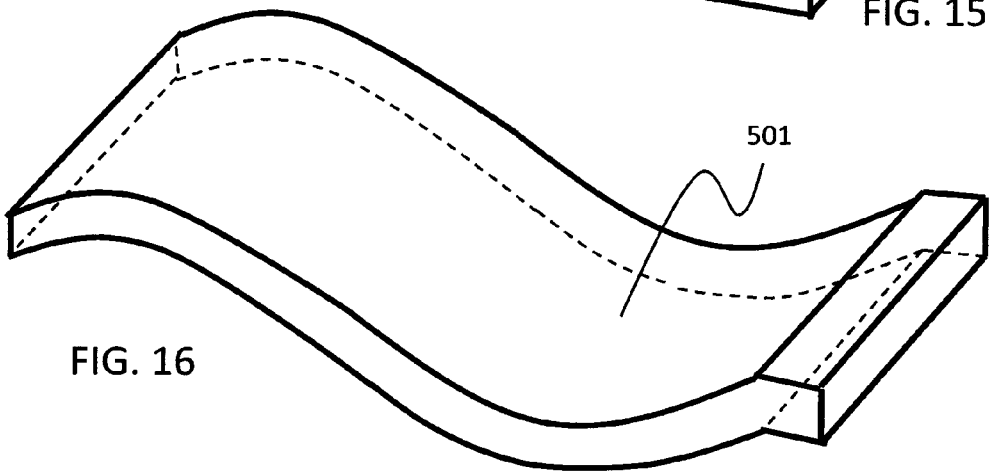
FIG. 16 is a perspective view of the curved top layer with an even thickness in the mattress body of FIG. 15.
Figure 17:
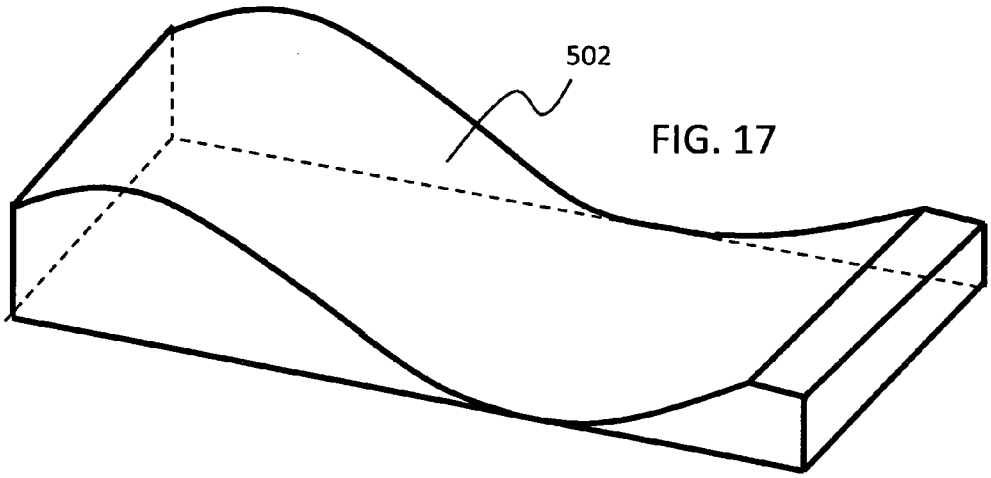
FIG. 17 is a perspective view of the bottom layer in the mattress body of FIG. 15.

FIG. 15, FIG. 16 and FIG. 17 illustrate another two layer configuration 500 of the mattress body according to the invention which includes the top layer 501 and the bottom layer 503 which are coupled together. The top layer 501 is made of elastic materials with an even thickness. The bottom layer 502 has an uneven thickness, which can be either made of elastic materials or non-elastic materials.

Figure 18:
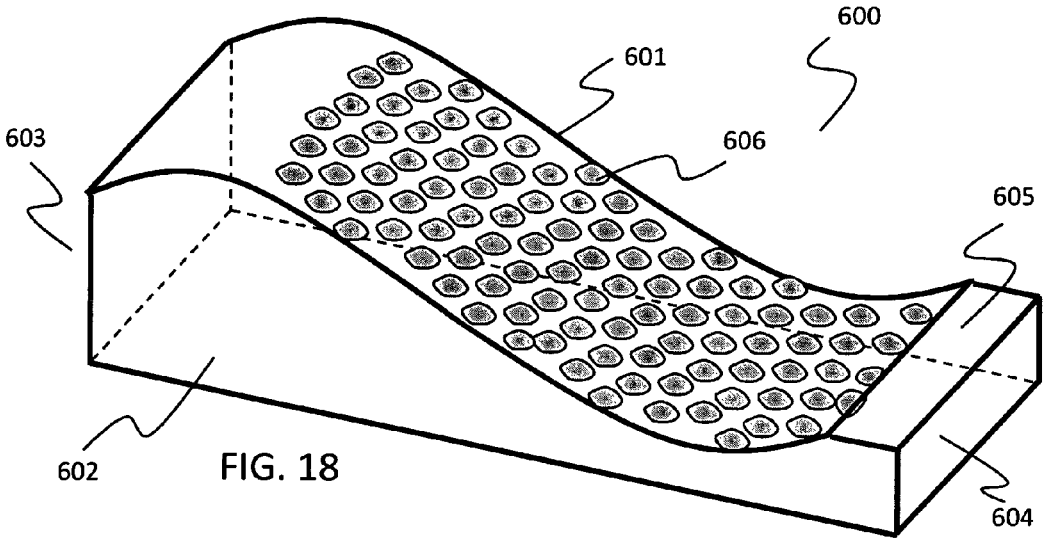
FIG. 18 is a perspective view of a mattress body with an array of ventilation pits carved on the main slope of the mattress body's top surface according to another embodiment of the invention.
Figure 19:
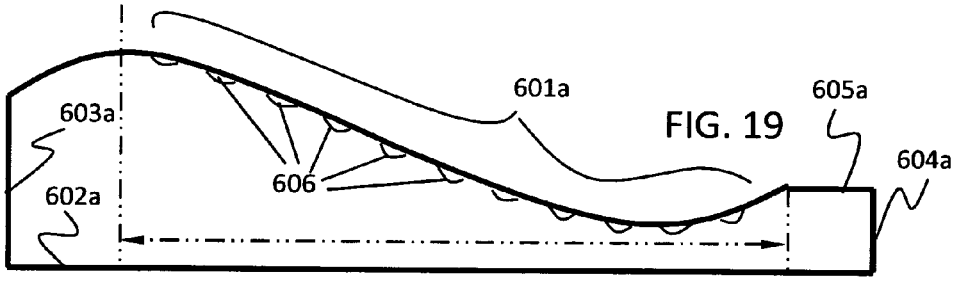
FIG. 19 is a side view of the mattress body of FIG. 18.
Figure 20:
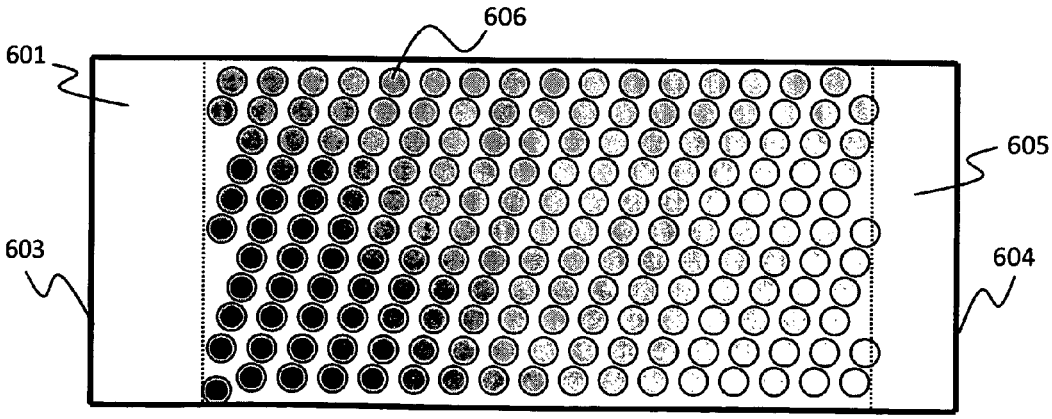
FIG. 20 is a top view of the mattress body of FIG. 18.

In another preferred embodiment, the mattress body includes an array of three dimensional ventilation pits carved on the main slope of the curved top surface. The ventilation pits on the main slope may help to avoid retention of too much body heat which can be dangerous for some infants. FIG. 18, FIG. 19 and FIG. 20 illustrate the perspective view, the side view and the top view of a configuration 600 with an array of ventilation pits 606. The ventilation pits 606 are carved in the main slope area 601*a*. Preferably, there are no ventilation pits in the tail area 505. In the exemplary embodiment illustrated in FIG. 18, the ventilation pits are in semi spherical shape. The pits are identical and are evenly spaced. The size and density of the ventilation pits may affect the firmness of the curved top surface. The diameter of the pit is preferably between ¼ and ⅓ inch.

Note that the ventilation pits can be in any shape, such as a baby's footprint, handprint, ear-prints or any other artistic shapes. The pits can be customized according to the buyer's preference. For example, the buyer may choose to user his or her child's footprint or handprint as the shape of the ventilating pits. When placing the order, the buyer provides a photo of the child's footprint or handprint. The manufacture or the retail store uses a computer aided carving machine to carve the footprint or handprint on the top curved surface of the body.

Design standards for infant mattress according to the invention include considerations such as preventing hand and head entrapment. Research has shown that the mattress influences SIDS outcomes; a firm mattress lowers SIDS risk.

Materials for the mattress body include urethane foam, visco elastic foam, latex foam, etc. The mattress body can be a single piece of elastic foam, or a single piece volume with multiple layers of different materials coupled together. The density of the mattress body is determined according to the materials, the size, the thickness, the density and format of the ventilation pits, and the tolerance range of average babies. To avoid SIDS, the top surface cannot be too soft. It must be elastic, firm enough, and comfortable for ordinary babies. If visco elastic foam is used, a range of density between 4 to 6 $lbs/ft^3$ is preferred. If urethane foam is used, a range of density between 1 to 2 $lbs/ft^3$ is preferred.

Figure 21:
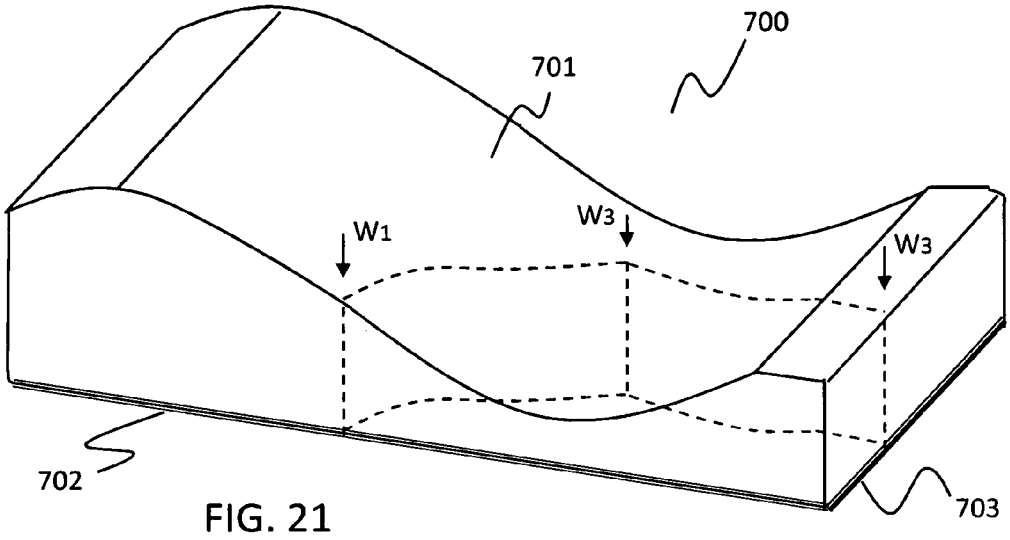
FIG. 21 is a perspective view of the infant mattress according to the invention.
Figure 22:
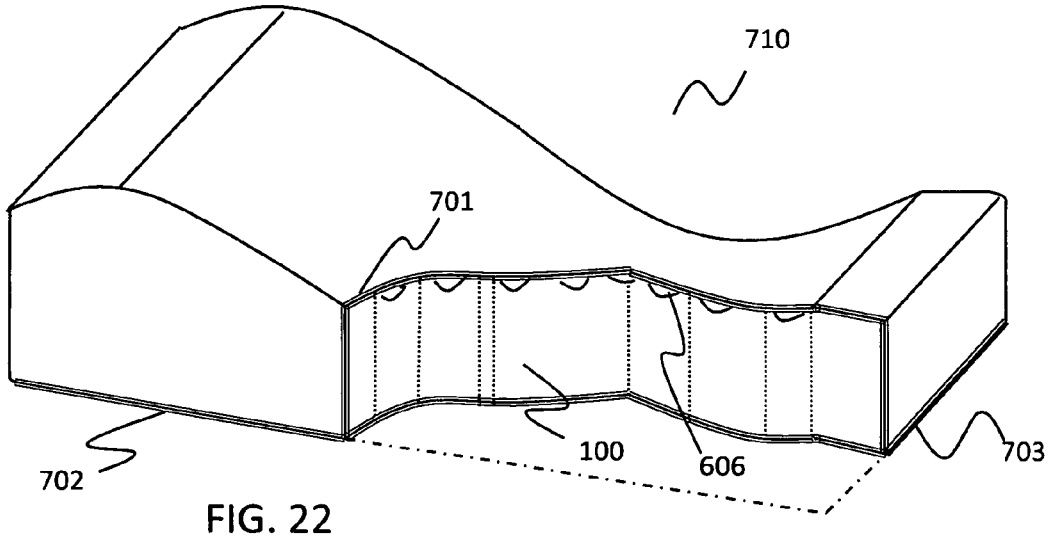
FIG. 22 is a carved-out perspective view of the infant mattress of FIG. 21 illustrating the mattress body with an array of ventilation pits encased by a mattress case.

FIG. 21 and FIG. 22 illustrate a perspective of the infant mattress 700 and a carved-out perspective view 710 of the infant mattress of 700 showing the mattress body 100 and the ventilation pits 606 encased by the mattress case 701. The mattress case 701 is preferably made of a stretchable textile. The case can be a one-end-open envelope or an enclosure with zipper. It is operable to stretch around the mattress body in order to provide proper engagement between the body and the case. The mattress case 701 includes zippers 702 and 703.

In another embodiment of the invention, the top curved surface of the infant mattress or baby bed add-on is an irregular surface. Irregular surface herein means that the surface is neither symmetrical to the longitudinal axis nor to the latitudinal axis. The irregular curved surface has multiple functions. For example, it provides ventilation underneath the mattress case. It provides the baby with special mattress experience and lets the baby feel special care with comfortableness. The present invention includes a service system providing customized irregular curved surface on the infant mattress. The service system includes the following components and steps: (1) a service provider or a retail store maintains a certain amount of inventory of premium infant mattress with regular curved top surface as described above; (2) a customer chooses a format from a list of pre-designed mattress surface; (3) the service provider collects one or more parameters related to the baby's physical measurements; (4) the service provider enters the parameters to the computer and make a customized design of the mattress surface using a software application; (5) upon confirmation of the customer on the design, the service provider carves the customized design to the premium infant mattress, using a computer controlled mattress carving machine.

The customized three dimensional shape carved on the curved surface's main slope is proportionally made by imitating an object, which can be any of: (1) a human ear; (2) a human foot print; (3) a human hand print; and (3) a three dimensional art work.

From the consumer's perspective, she first chooses a mattress body of proper size for her baby. Then, she decides to have some features of her baby be associated with the three-dimensional shape to be carved on the curved top surface of the mattress body. For example, she likes her baby's ear very much and thus she wants to have a big ear immigrating her baby's ear to be carved on the curved top surface. The server takes pictures of her baby's ear using a camera or camcorder, and uses a computer program to make some adjustments such as the flatness and thickness of the shape. Upon confirmation by the consumer, the server uses a computer controlled machine to carve the shape on the curved top surface of the chosen mattress body. The mattress made in this way is unique because the shape on the curved top surface is associated to the baby's identities.

In manufacturing, the 90 degree sharp edges in the above described embodiments shall be replaced by arc or round edges.

As far as belly-sleeping is concerned, the curved mattress as described above has numerous advantages over the conventional flat mattress. First, it enables the baby to turn her head more easily. Second, it gives the baby a bigger space to breath and thus the chance to re-breath is reduced. Third, sleeping on the slope, the baby has less chance to choke on fluids she brings up. Fourth, sleeping on the slope, the baby's chance to get positional facial and head deformities is lower.

The apparatus described above can be either used separately as an infant mattress which is placed in a conventional infant bed, i.e. crib or cot, or be used as an add-on to an existing mattress. It can be also used as portable bed which is movable from one place, such as the crib, to the parents' bed, or from bedroom to the living room.

It is to be understood, however, that even though numerous characteristics and advantages of the present invention have been set forth in the foregoing description, together with details of the structure and function of the invention, the disclosure is illustrative only, and changes may be made in detail, especially in matters of angle, shape, size, and arrangement of parts within the principles and spirits of the invention to the full extent indicated by the broad general meaning of the terms in which the appended claims are expressed.

What is claimed is:

1. An infant mattress comprising a single piece three-dimensional body with elastic properties and a textile case encasing said body, wherein said body has a top view of a rectangle, a curved top surface, a planar bottom surface located opposite of said curved top surface, a pair of identical longitudinal side surfaces paralleling to each other, and two latitudinal side surfaces paralleling to each other, wherein each of said longitudinal side surfaces comprises a curved top line, a first vertical line, a horizontal bottom line and a second vertical line paralleling to said first vertical line, said bottom line being connected to said first vertical line's and said second vertical line's lower ends respectively, said curved top line being connected to said first vertical line and said second vertical line's upper ends respectively, wherein said curved top line comprises a sine wave and a tail line segment, said sine wave comprising one crest segment and one trough segment only, said tail line segment being connected to an end of said trough segment, and wherein said curved top surface is formed by a translational motion of said curved top line along said rectangle's latitudinal direction for a distance of said rectangle's width.

2. An infant mattress according to claim 1, wherein said sine wave is any of:

a curve consisting of a full crest and a full trough;
a curve consisting of a full crest and a partial trough;
a curve consisting of a partial crest and a full trough; and
a curve consisting of a partial crest and a partial trough.

3. An infant mattress according to claim 1, wherein said tail line segment is any of:

a segment of a straight line;
a circular arc;
a segment of an ellipse;
a segment of a hyperbola;
a segment of a parabola;
a segment of said sine wave with a horizontal length shorter than one fourth of said sine wave's wavelength; and
a combination of two or more of above.

4. An infant mattress according to claim 1, wherein said sine wave consists of a partial crest and a full trough, wherein said body's longitudinal length is substantially equal to said sine wave's wavelength, and wherein said tail line segment's length is substantially equal to a longitudinal length corresponding to a segment of crest which makes said partial crest a full crest.

5. An infant mattress according to claim 1, wherein said body comprises an array of three dimensional ventilation pits carved on said curved surface's main slope.

6. An infant mattress according to claim 1, wherein said body comprises a three dimensional shape carved on said curved surface's main slope, said shape being proportionally customized by imitating a three dimensional object.

7. An infant mattress according to claim 6, wherein said three dimensional object is any of:

a baby's ear;
a baby's foot print;
a baby's hand print; and
a three dimensional art work.

8. An infant mattress according to claim 1, wherein said body is made of elastic materials.

9. An infant mattress according to claim 1, wherein said body comprises two or more layers coupled together, each two neighboring layers being made of different materials.

10. An infant mattress according to claim 9, wherein a bottom layer comprises a plastic case and a drawer detachably coupled to said case.

11. A method for making an infant mattress with curved top surface, comprising the steps of:

providing a single piece three dimensional body with elastic properties; and
providing a stretchable textile case for encasing said body;
wherein said body has a top view of a rectangle, a curved top surface, a planar bottom surface located opposite of said curved top surface, a pair of identical longitudinal side surfaces paralleling to each other, and two latitudinal side surfaces paralleling to each other;
wherein each of said longitudinal side surfaces comprises a curved top line, a first vertical line, a horizontal bottom line and a second vertical line paralleling to said first vertical line, said bottom line being connected to said first vertical line's and said second vertical line's lower ends respectively, said curved top line being connected to said first vertical line's and said second vertical line's upper ends respectively;
wherein said curved top line comprises a sine wave and a tail line segment, said sine wave comprising one crest segment and one trough segment only, said tail line segment being connected to an end of said trough segment; and
wherein said curved top surface is formed by a translational motion of said curved top line along said rectangle's latitudinal direction for a distance of said rectangle's width.

12. The method according to claim 11, wherein said sine wave is any of:

a curve consisting of a full crest and a full trough;
a curve consisting of a full crest and a partial trough;
a curve consisting of a partial crest and a full trough; and
a curve consisting of a partial crest and a partial trough.

13. The method according to claim 11, wherein said tail line segment is any of:

a segment of a straight line;
a circular arc;
a segment of an ellipse;
a segment of a hyperbola;
a segment of a parabola;
a segment of said sine wave with a length shorter than one fourth of said sine wave's wavelength; and
a combination of two or more of above.

14. The method according to claim 11, wherein said sine wave consists of a partial crest and a full trough; wherein said body's longitudinal length is substantially equal to said sine wave's wavelength, and wherein said tail line segment's length is substantially equal to a longitudinal length corresponding to a segment of crest which makes said partial crest a full crest.

15. The method according to claim 11, further comprising the step of:

carving an array of three dimensional ventilation pits on said curved surface's main slope.

16. The method according to claim 11, further comprising the step of:

carving a three dimensional shape on said curved surface's main slope, said shape being proportionally customized by imitating a three dimensional object.

17. The method of claim 16, wherein said three dimensional object is any of:

a baby's ear;

a baby's foot print;

a baby's hand print; and a three dimensional art work.

18. The method according to claim 11, wherein said body is made of elastic materials.

19. The method according to claim 11, wherein said step of providing a single piece three dimensional body further comprises the steps of:

providing a first layer with a curved top surface;

coupling said first layer to a second layer;

wherein said first layer and said second layer are made of different materials.

20. The method according to claim 19, further comprising the step of:

providing a bottom layer comprising a plastic case and a container detachably coupled to said plastic case.

* * * * *